US008550215B2

(12) United States Patent
Linton et al.

(10) Patent No.: US 8,550,215 B2
(45) Date of Patent: Oct. 8, 2013

(54) STAIRLIFTS

(75) Inventors: Nicholas Paul Linton, Hampshire (GB); Martyn Harry Jenkins, Wiltshire (GB)

(73) Assignee: Stannah Stairlifts Limited, Hampshire (GB)

( * ) Notice: Subject to any disclaimer, the term of this patent is extended or adjusted under 35 U.S.C. 154(b) by 680 days.

(21) Appl. No.: 12/733,682

(22) PCT Filed: Sep. 22, 2008

(86) PCT No.: PCT/GB2008/003202
§ 371 (c)(1),
(2), (4) Date: Jun. 10, 2010

(87) PCT Pub. No.: WO2009/040506
PCT Pub. Date: Apr. 2, 2009

(65) Prior Publication Data

US 2010/0263966 A1 Oct. 21, 2010

(30) Foreign Application Priority Data

Sep. 25, 2007 (GB) ..... 0718710.7

(51) Int. Cl.
*B66B 9/08* (2006.01)

(52) U.S. Cl.
USPC ..... 187/201; 187/202

(58) Field of Classification Search
USPC ..... 187/202, 201
See application file for complete search history.

(56) References Cited

U.S. PATENT DOCUMENTS

| | | | | |
|---|---|---|---|---|
| 4,913,264 | A * | 4/1990 | Voves et al. | 187/201 |
| 5,230,405 | A * | 7/1993 | Bartelt | 187/201 |
| 5,533,594 | A | 7/1996 | Tremblay et al. | |
| 5,992,935 | A * | 11/1999 | Duijnstee | 297/344.21 |
| 6,679,353 | B1 * | 1/2004 | Muranaka | 187/202 |
| 7,225,899 | B2 * | 6/2007 | Molnar et al. | 187/201 |
| 7,296,659 | B2 * | 11/2007 | Carlsen | 187/201 |
| 7,600,611 | B2 * | 10/2009 | Woodhams et al. | 187/201 |
| 7,708,117 | B2 * | 5/2010 | van der Heiden | 187/201 |

FOREIGN PATENT DOCUMENTS

| | | |
|---|---|---|
| FR | 2 699 907 | 7/1994 |
| GB | 2 368 574 | 5/2002 |
| WO | WO 97/19886 | 6/1997 |
| WO | WO 2005/012152 | 2/2005 |

OTHER PUBLICATIONS

International Search Report for PCT/GB2008/003202, mailed Dec. 16, 2008.

* cited by examiner

*Primary Examiner* — William A Rivera
*Assistant Examiner* — Michael Riegelman
(74) *Attorney, Agent, or Firm* — Nixon & Vanderhye, PC

(57) ABSTRACT

The invention provides a manual two-way swivel mechanism for a stairlift. The mechanism allows the stairlift chair to be swivelled in an uphill direction only, at the carriage is at the top of the rail; and in a downhill direction only, when the carriage is at the bottom of the rail. An interlock is provided which regulates the direction in which the chair can be swivelled.

18 Claims, 5 Drawing Sheets

STAIRLIFTS

This application is the U.S. national phase of International Application No. PCT/GB2008/003202 filed 22 Sept. 2008 which designated the U.S. and claims priority to GB Patent Application No. 0718710.7 filed 25 Sept. 2007 ,the entire contents of each of which are hereby incorporated by reference.

FIELD OF THE INVENTION

This invention relates to stairlifts and, in particular, to a chair swivel facility for a stairlift.

BACKGROUND TO THE INVENTION

It is known to provide a stairlift with a chair swivel facility to enable the chair to be swivelled at the top of the rail. This facility not only makes mounting and dismounting easier for a user, but also enhances safety as, in the swivelled position, the chair projects further into the staircase. In the past it has been considered important that the chair cannot be swivelled in a downhill direction when the stairlift is at the top of the rail. As a consequence, swivel mechanisms are typically configured only to allow rotation through 90°. This has a drawback that the chair cannot be swivelled at the bottom of the rail to facilitate mounting and dismounting at that end of the rail.

In our published International Patent Application No. WO 2005/012152 we describe a two-way powered swivelling mechanism which enables the chair to be swivelled, in opposite directions, at the top and bottom of the rail. Suitable electrical/electronic interlocks ensure that the chair only swivels in the downhill direction at the bottom of the rail, and in the uphill direction at the top of the rail. However a powered system such as this including two motor/gearbox units, and associated worm drives, adds considerable complexity and cost to a stairlift.

It is an object of the invention to provide a stairlift which will go at least some way in addressing the aforementioned problems; or which will at least provide a novel and useful choice.

SUMMARY OF THE INVENTION

Accordingly, in a first aspect the invention provides a stairlift including a stairlift rail having an upper end and a lower end; a carriage displaceable along said rail, a chair mounted on said carriage; and a manually operable swivel mechanism operable to allow said chair to swivel about a substantially vertical axis, when said carriage is positioned at the upper and lower ends of said rail; said stairlift being characterised in that interlock means are provided, said interlock means being configured to prevent said chair being swivelled in a downhill direction at the upper end of said rail and being swivelled in an uphill direction at the lower end of said rail.

Preferably said interlock means is configured to operate without human intervention.

Preferably said interlock means is operated through engagement of said carriage with a bottom limit stop on said rail.

Preferably said swivel mechanism includes a fixed index plate having a central indent defining a running position for said chair; an end indent on either side of said central indent to define swivelled positions of said chair; a pin mounted on and moveable with said chair, said pin being displaceable into and out of each of said indents; said interlock means including a moving stop displaceable between positions to either side of said central indent and being configured and operable to confine movement of said pin between said central indent and only one of said end indents.

Preferably said interlock means further includes a motor to displace said moving stop.

Preferably said interlock means includes one or more switches to determine the position of said moving stop.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One working embodiment of the invention will now be described with reference to the accompanying drawings in which.

DETAILED DESCRIPTION OF WORKING EMBODIMENT

Figure 1:
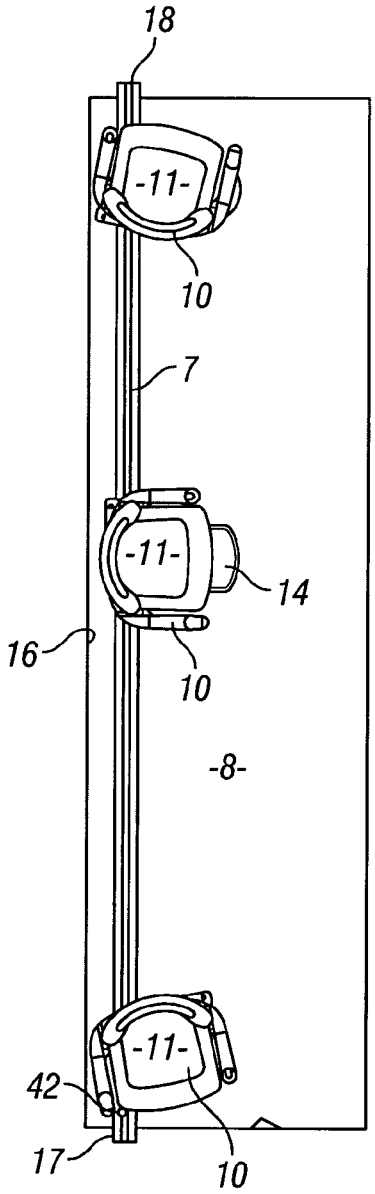
FIG. 1: shows a plan view of a straight stairlift installation with the carriage and chair in three different positions along the rail.

The invention provides a manually operating mechanism for a stairlift 5, the stairlift comprising a carriage 6 displaceable, in the conventional sense, up and down a rail 7 mounted on a staircase 8. Mounted on the carriage 6, via an interface 9, is a chair 10. The chair 10 includes a seat base 11, a backrest 12 and a pair of armrests 13. A foot rest 14 is typically provided at the lower edge of the interface 9.

Figure 2:
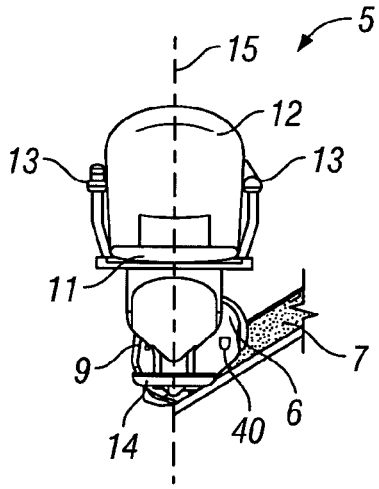
FIG. 2: shows a front elevation of a carriage and chair assembly on a section of rail.

The swivel mechanism which will be described in greater detail below, enables the chair 10 to be swivelled, with respect to the interface 9, about vertical axis 15 (FIG. 2). As can be seen in FIG. 1, the chair is aligned perpendicular to wall 16 when in the running position—the middle position as shown in the Figure. When the carriage is at the bottom 17 of the rail, the chair 10 may be swivelled in a downhill direction whilst, when the carriage is at the top 18 of the rail, the chair may be swivelled in an uphill direction as shown. An important feature of the invention is that the swivel mechanism includes an interlock facility which prevents the chair 10 from swivelling in a downhill direction when the carriage is other than at the bottom 17 of the rail.

Turning now to FIGS. 3 to 7, mounted on the underside of seat base 11 is a manual lever arrangement which includes a rotatable transverse shaft 20. Mounted on opposite ends of the shaft 20 are swivel levers 21, the levers 21 being positioned so that they fall easily to opposite hands of a user seated in the chair 10. Mounted substantially midway along the shaft 20 is an operating facility which co-operates with a locking pin 22 such that, as one of the levers 21 is depressed to rotate the shaft 20, the locking pin 22 is displaced toward the rear edge of the seat base 11. As will be described in greater detail below, a spring bias is preferably provided so that the levers are biased upwards or, put another way, the locking pin is biased forwardly.

The swivel mechanism further includes an index plate 25 which is fixed to the upper edge of the interface 9 so as to lie adjacent and parallel to the under surface of the seat base 11. As can be seen, the index plate includes a first arcuate slot 26, the geometric centre of which lies on the swivel axis 15. It will further be noted that the slot 26 includes a series of indents along the inner edge. Central indent 27 defines the central or running position of the chair while end indents 28*a* and 28*b* define limit stops for the swivelling movement which may be applied to the chair when the carriage is positioned at the ends of the rail. Intermediate indents 29 may also be provided to allow the chair to be locked between the running position and the fully-swivelled positions.

Figure 3:
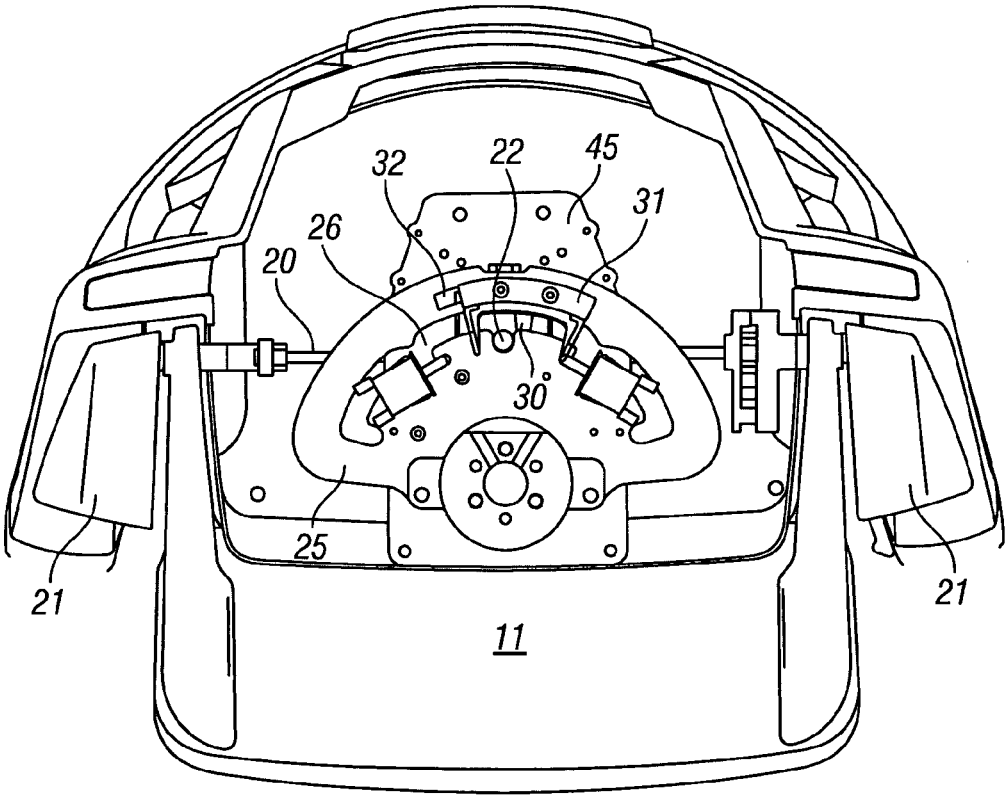
FIG. 3: shows an isometric view, from below, of a manual swivel mechanism able to be incorporated in stairlift shown in FIGS. 1 & 2, with certain parts omitted for clarity.
Figure 6A:
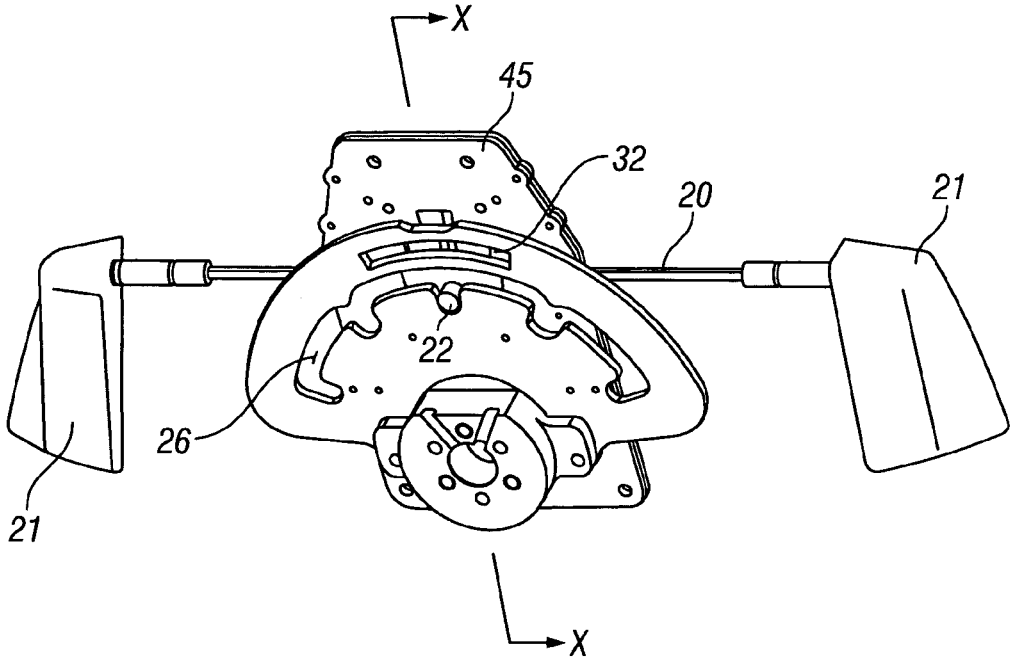
FIG. 6A: shows a manual locking lever arrangement and index plate included in the swivel mechanism shown in FIGS. 3 to 5, in a locked configuration.

When the chair 10 is mounted on the interface 9, the locking pin 22 is engaged in the arcuate slot 26 and is biased toward that edge of the slot which includes the indents 27, 28 and 29. Thus, when the chair is arranged in the running position, the locking pin 22 is engaged in central indent 27 as is shown in FIGS. 3 and 6A. When the chair is fully swivelled at either the top or bottom of the rail, the locking pin is engaged in the appropriate one of indents 28*a* or 28*b*.

In practice, because the invention is configured to ensure the chair can only swivel between the running position and either the uphill or the downhill direction, an interlock is provided to ensure the locking pin is confined to sliding between one of the end stops defined by indents 28*a* and 28*b*, and the central running position defined by indent 27. In the form shown, the interlock is comprised, principally, by a moveable stop 30 which can be selectively positioned on either side of central indent 27 whilst the locking pin 22 is fully engaged in the central indent 27.

Figure 4:
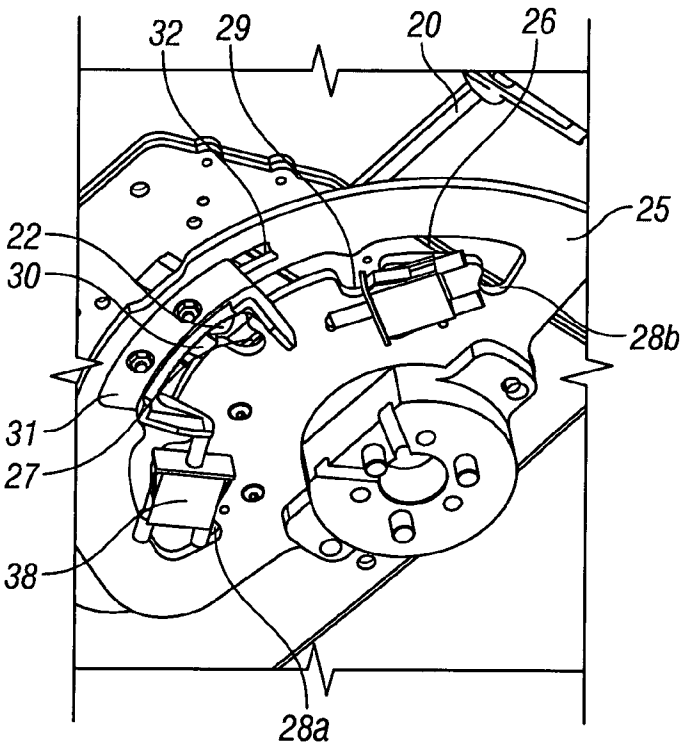
FIG. 4: shows an enlarged view of part of what is shown in FIG. 3.

In the form shown, the moveable stop 30 comprises a spigot which projects into the slot 26, the spigot being formed as part of, or being attached to, a slider 31 located in a further, outer, arcuate slot 32. As the slider 31 is displaced between opposite ends of slot 32, the stop 30 is positioned on either side of central indent 27. Thus the locking pin 22 can only slide, in slot 26, between the central indent 27 and either the end indent 28*a* or the end indent 28*b* depending on the position of the stop 30. As shown in FIG. 3, the stop 30 is positioned to enable the locking pin to slide between the central indent 27 and the end stop indent 28*a*. FIG. 4 shows the alternative position of the stop 30, in which position the locking pin 22 can slide between central indent 27 and end indent 28*b*.

Figure 5:
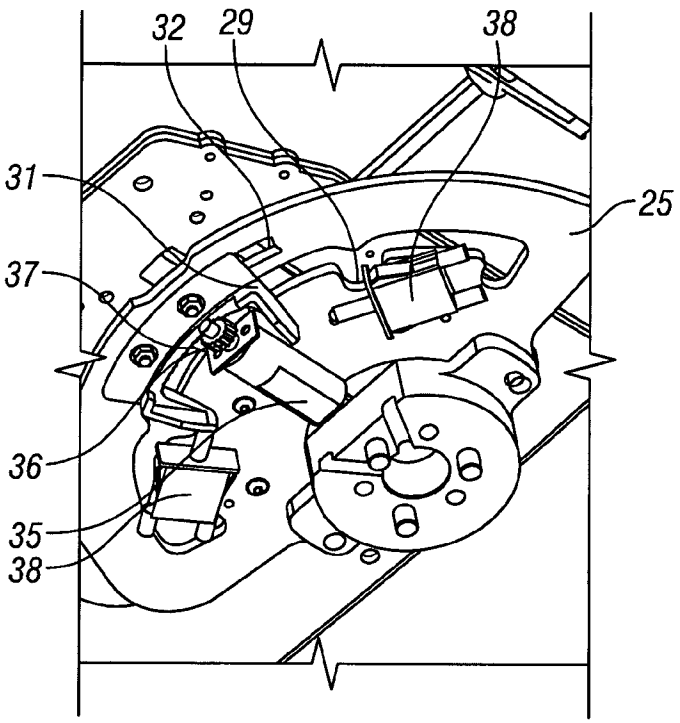
FIG. 5: shows a view similar to FIG. 4, but with added detail of an interlock drive facility.

Referring now to FIG. 5, the stop 30, and its associated slider 31 may displaced between its alternative positions by means of a reversible electric motor 35 having a pinion 36 mounted on the output thereof. The pinion engages with a toothed rack section 37 on the slider 31 and thus operation of the motor 35 displaces the slider. Switches 38 are mounted for engagement with opposite sides of the slider 31, thus enabling an electric or electronic signal to be generated indicating if the stop is positioned to allow swivelling in the uphill, or in the downhill, direction.

It will be appreciated that the slider could be displaced by other forms of electro-mechanical device including, for example, a solenoid.

It is envisaged that the motor 35 will be under the command of the main stairlift electronic control unit (ECU) indicated schematically at 40 in FIG. 2. In this way suitable interlocking is provided to ensure the swivel mechanism can only operate as intended.

As one example of control, the default position of the swivel mechanism described above is with the moveable stop positioned to allow the chair to swivel in the uphill position only. This default positioned is maintained until the carriage, moving clown the rail and with the chair in the central or running position, engages lower limit stop, shown schematically at 42 in FIG. 1. When the limit stop 42 is contacted, a signal is sent to the ECU to operate the motor 35 and thus re-position the movable stop 30 to the opposite side of central indent 27. The swivel mechanism can be then manually operated and the chair swivelled into a downhill direction. When a user next desires to travel up the staircase 8, the user seats themselves in the chair and swivels the chair to the central or running position. The directional control is then operated to move the carriage 6 up the rail 7. It is envisaged that, when the directional control is operated to move the carriage up from the bottom stop 42, the ECU will determine, from switches 38, the position of movable stop 30, and will not allow the main carriage drive motor to operate until stop 30 has been positioned on that side of the central indent 27 which only allows swivelling in the uphill direction.

Figure 6B:
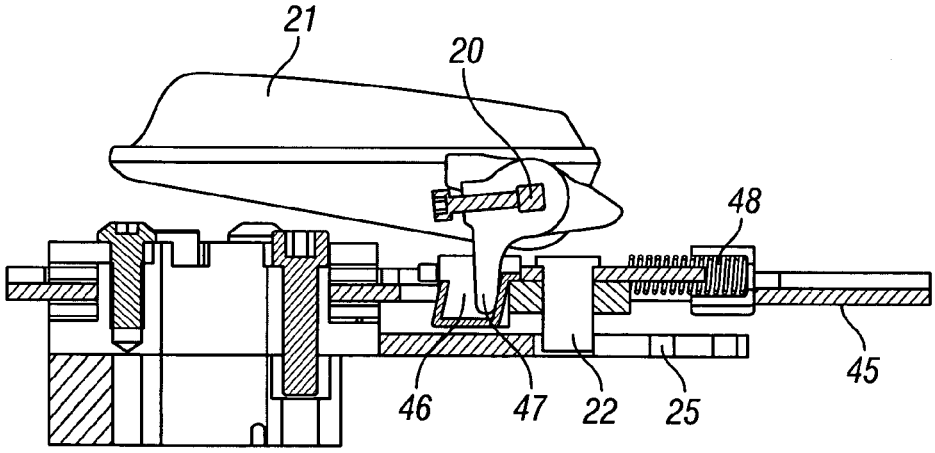
FIG. 6B: shows, in a larger scale, a cross-section along X-X in FIG. 6A.
Figure 7A:
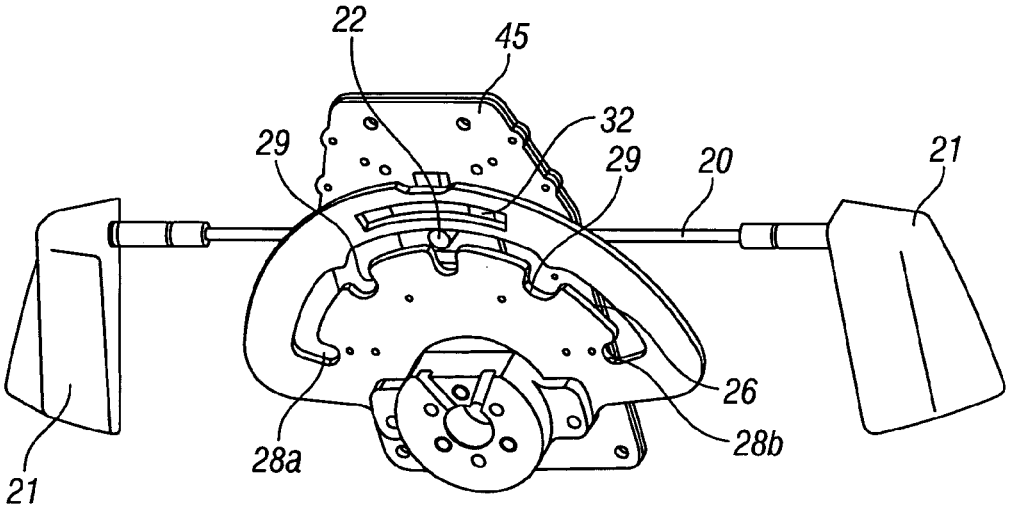
FIG. 7A: shows a view which corresponds to FIG. 6A, but with the swivel mechanism unlocked.
Figure 7B:
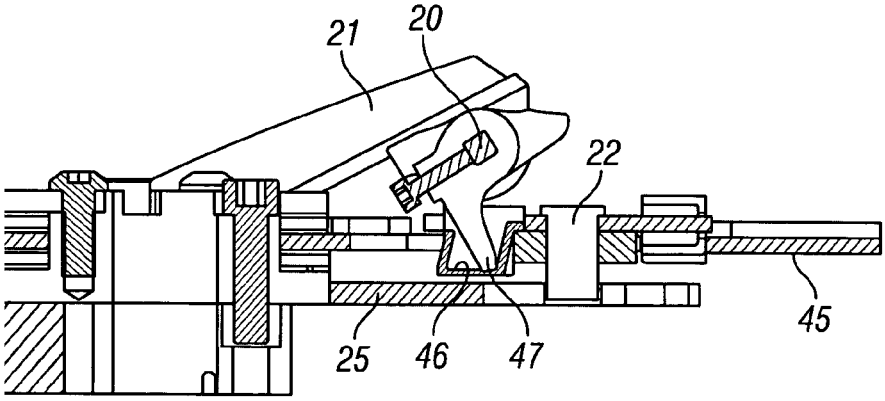
FIG. 7B: shows a view which corresponds to FIG. 6B, but with the swivel mechanism unlocked.

Turning now to FIGS. 6A, 6B and 7A, 7B the locking pin 22 is preferably included in a slider facility 45 fixed to the underside of the chair base 11 such that the locking pin 22 slides in a plane parallel to the plane of the index plate 25. As can be seen in FIGS. 6B and 7B a socket 46 is included in the slider mechanism and receives a finger 47 fixed to the mid-point of lever shaft 20. When one of the operating levers 21 is depressed, the finger 47 acts against the edge of socket 46 thus displacing the locking pin rearwardly and out of engagement with whichever of the indents it is then engaged.

FIG. 6B also shows the inclusion of a coil spring 48 to bias the locking pin toward that edge of slot 26 which includes the locking indents. Depression of levers 21 is against the bias of spring 48.

It will thus be appreciated that the present invention provides a simple yet effective form of manual chair swivel for a stairlift which provides the required level of safety but which avoids the expense and complexity of fully powered swivel mechanisms.

The invention claimed is:

1. A stairlift including a stairlift rail having an upper end and a lower end; a carriage displaceable along said rail, a chair mounted on said carriage; and a manually operable swivel mechanism operable to allow said chair to swivel only about a single substantially vertical axis yet being configured to prevent said chair being swiveled in a downhill direction at the upper end of said rail and being further configured to prevent said chair being swiveled in an uphill direction at the lower end of said rail, said swivel mechanism including a fixed index plate having a central indent defining a running position for said chair; an end indent on either side of said central indent to define swiveled positions of said chair; a pin mounted on and moveable with said chair, said pin being displaceable into and out of each of said indents; and a moving stop mounted on said index plate and being displaceable between positions to either side of said central indent, said moving stop being configured and operable to confine movement of said pin between said central indent and only one of said end indents.

2. A stairlift as claimed in claim 1 wherein said swivel mechanism is configured that so displacement of said moving stop is effected without human intervention.

3. A stairlift as claimed in claim 2 wherein said moving stop is displaced in response to engagement of said carriage with a bottom limit stop on said rail.

4. A stairlift as claimed in claim 3 wherein said moving stop is incorporated in a slider.

5. A stairlift as claimed in claim 2 wherein said swivel mechanism further includes a servo motor to displace said moving stop.

6. A stairlift as claimed in claim 5 further including one or more switches to determine the position of said moving stop.

7. A stairlift as claimed in claim 5 wherein said moving stop is incorporated in a slider.

8. A stairlift as claimed in claim 2 wherein said moving stop is incorporated in a slider.

9. A stairlift as claimed in claim 1 wherein said moving stop is displaced in response to engagement of said carriage with a bottom limit stop on said rail.

10. A stairlift as claimed in claim 9 wherein said swivel mechanism further includes a servo motor to displace said moving stop.

11. A stairlift as claimed in claim 10 further including one or more switches to determine the position of said moving stop.

12. A stairlift as claimed in claim 10 wherein said moving stop is incorporated in a slider.

13. A stairlift as claimed in claim 9 wherein said moving stop is incorporated in a slider.

14. A stairlift as claimed in claim 1 wherein said swivel mechanism further includes a servo motor to displace said moving stop.

15. A stairlift as claimed in claim 14 further including one or more switches to determine the position of said moving stop.

16. A stairlift as claimed in claim 15 wherein said moving stop is incorporated in a slider.

17. A stairlift as claimed in claim 14 wherein said moving stop is incorporated in a slider.

18. A stairlift as claimed in claim 1 wherein said moving stop is incorporated in a slider.

* * * * *